US005108862A

United States Patent [19]

Kishimoto et al.

[11] Patent Number: 5,108,862

[45] Date of Patent: Apr. 28, 1992

[54] COMPOSITE CARRIER PARTICLES FOR ELECTROPHOTOGRAPHY AND PROCESS FOR PRODUCING THE SAME

[75] Inventors: Souichiro Kishimoto, Ohnojyo; Tsutomu Sakaida; Yoshiaki Echigo, both of Uji; Keiichi Asami, Jouyou; Tetsuro Toda, Hiroshima; Kazuo Fujioka, Hiroshima; Eiichi Kurita, Hiroshima; Toshiyuki Hakata, Hiroshima; Shigeru Takaragi, Hiroshima, all of Japan

[73] Assignees: Toda Kogyo Corp., Hiroshima, Japan; Unitika Ltd., Hyogo, Japan

[21] Appl. No.: 480,492

[22] Filed: Feb. 16, 1990

[30] Foreign Application Priority Data

Feb. 21, 1989 [JP] Japan ..... 1-42320
Dec. 21, 1989 [JP] Japan ..... 1-333243

[51] Int. Cl.[5] ..... G03G 9/14
[52] U.S. Cl. ..... 430/108; 430/106.6
[58] Field of Search ..... 430/106.6, 108

[56] References Cited

U.S. PATENT DOCUMENTS 4,640,971 2/1987 Echigo et al. ..... 528/129
4,654,287 3/1987 Okuyama et al. ..... 430/106.6
4,839,445 6/1989 Echigo et al. ..... 525/503

FOREIGN PATENT DOCUMENTS 142731 5/1985 European Pat. Off. .

*Primary Examiner*—Marion E. McCamish
*Assistant Examiner*—S. Rosasco
*Attorney, Agent, or Firm*—Nixon & Vanderhye

[57] ABSTRACT

Disclosed herein are composite carrier particles for electrophotography comprising 80 to 99% by weight of ferromagnetic fine particles and a phenol resin, and having a number-average particle diameter of 10 to 1,000 μm, a bulk density of not more than 2.0 g /cm$^3$, and a curved surface configuration, and a process for producing the same.

13 Claims, 4 Drawing Sheets

COMPOSITE CARRIER PARTICLES FOR ELECTROPHOTOGRAPHY AND PROCESS FOR PRODUCING THE SAME

BACKGROUND OF THE INVENTION

The present invention relates to composite carrier particles comprising ferromagnetic fine particles and a phenol resin, and having a low bulk density and high electric resistance, and a process for producing such composite carrier particles. Such composite carrier particles have as high saturation magnetization as possible owing to the high content of ferromagnetic fine particles and are serviceable as magnetic carrier for electrophotography.

In electrophotography, a developing method is prevalently used in which an electrostatic latent image is formed by various means by using a photoconductive material such as selenium, OPC (Organic photoconductor), α-Si or the like as photoconductive material, and a toner electrically charged to an opposite polarity to the latent image is made to adhere to the latent image with electrostatic force by using, for instance, a magnetic brush development, thereby developing the latent image.

In the developing process, there are used carrier particles which are usually referred to simply as carrier, an appropriate quantity of positive or negative electricity is applied to the toner through frictional charging, and the charged toner is transferred to the developing zone near the surface of the photoconductive layer where the latent image is formed, through the medium of a magnet-incorporated development sleeve, by making use of magnetic force.

Recently, with increasing a tendency to speed-up, continuation and higher performance of copying machines, the a demand for the improvement of properties of carrier used in such copying machines.

The carrier used for the said purpose is required to have the following properties: low in bulk density, large in saturation magnetization and high in electric resistance.

When the bulk density of the carrier particles is high, there is required a large driving force for stirring in the developing apparatus, resulting in early mechanical wear, production of spent toner, deterioration of charging characteristics of the carrier itself and damage to the photoconductive layer. It is, therefore, keenly required that the carrier particles are low in bulk density.

Also, low saturation magnetization weakens the magnetic adhesive force of carrier to the development sleeve, thereby causing release of the carrier particles from the development sleeve and their adhesion to the surface of the photoconductive layer. Thus, large saturation magnetization of the carrier particles has also been a strong requirement.

As for the electric resistance, it is required that the magnetic carrier have as high electric resistance as possible because of the necessity to control frictional chargeability of toner for forming a clear image.

Hitherto, iron-powder carrier, ferrite carrier and binder-type carrier (resin particles having fine magnetic particles dispersed therein) have been developed and practically used as a magnetic carrier.

The magnetic carrier particles having low bulk density, large saturation magnetization and high electric resistance are most keenly required at present, but there are no magnetic carrier particles yet available which can be amply satisfy these property requirements.

Regarding the iron particles carrier, there are available flaky particles, sponge-like particles or spherical particles, but since true specific gravity of these particles is 7 to 8, their bulk density is as high as 3 to 4 $g/cm^3$ and their electric resistance is as low as $10^2$ to $10^3$ Ω.cm, a large driving force is necessitated for stirring in the developing apparatus, which leads to early mechanical wear of the apparatus, resulting in production of spent toner, deterioration of charging characteristics of carrier itself and damage to photoconductive layer.

As a means for increasing electric resistance, it is practiced to treat the subject particles with an organic solvent containing a resin, thereby coating the surface of the iron-particles with the resin. According to this method, however, because of low throughput rate, the coating of the surface of the iron particles tends to become insufficient and non-uniform, and the effect of increasing the electric resistance is unsatisfactory. Therefore, the same treatment must be repeated several times. This causes complex and troublesome operations. Thus this method is disadvantageous industrially and economically. Further, oxide coating film of the surface of the iron particles is liable to peel off and also unstable as oxidation may take place and advance in certain environmental conditions. Thus, there tends to occur peeling and cracking of resin coating and the coated surface of the iron particles may be partly exposed, thereby causing disturbance of charging characteristics.

Ferrite particles carrier are spherical in shape, with their true specific gravity being about 4.5 to 5.5 and their bulk density being about 2 to 3 $g/cm^3$. The ferrite particles carrier, therefore, can obviate the problem of weight which is the defect of the iron-powder carrier, but the ferrite particles carrier is still unable to adapt itself satisfactorily to high speed copying machines where the development sleeve or the magnet therein rotates at high speed, or high speed laser beam printers for general purpose computers.

Binder-type carrier is low in bulk density (less than 2 $g/cm^3$), but as described in Japanese Patent Publication No. 59-24416 (1984), this binder-type carrier is produced by mixing and melting magnetic fine particles and a matrix resin, and then cooling and pulverizing the molten mixture. The produced particles, therefore, are low in magnetization, and accordingly they have the problem that their magnetic adhesive force to the development sleeve is weak, which tends to cause release of carrier particles from the development sleeve and adhesion to the photoconductive layer. Also, these carrier particles are irregular in shape and poor in fluidity, so that they are hard to stir and tend to cause non-uniformity in development, so that this binder-type carrier is unsatisfactory for its application to high-speed development where especially good fluidity of the developer is required.

It is also attempted to obtain a binder-type carrier having a curved particle-surface, especially a spherical binder-type carrier. It is possible, as described in Japanese Patent Application Laid-Open (KOKAI) No. 59-1967 (1984), to obtain spherical particles by mixing a thermoplastic resin and ferromagnetic fine particles, pulverizing the resultant mixture and further subjecting it to hot-air treatment. But in this case, it is hardly possible to make the ferromagnetic fine particles content of not less than 80% by weight, and there are cases where it is impossible to secure magnetism necessary for preventing scattering of the carrier particles during high speed development, although designing of the developing apparatus is partly responsible therefor. In case of dispersing spinel ferrite particles such as magnetite particles for pigment having submicron in diameter into a thermoplastic resin by kneading. usually when the content of such spinel ferrite particles exceeds 80% by weight, there is noted a tendency that the hot-melt mixture increases in viscosity and decreases in fluidity, and as a result it is difficult to perform the kneading. Even if the kneading can be performed, it is hardly possible to make the pulverized particles spherical by a hot-air treatment because of the high viscosity of the melt.

In the production of a binder-type carrier, a thermoplastic resin is usually used as the matrix resin, but in this case, the produced magnetic carrier particles are weak in strength and may be split into finer particles, which may become a cause of fogging of the developed image. In Japanese Patent Application Laid-Open (KOKAI) No. 58-136052 (1983) the use of a thermosetting resin in place of thermoplastic resin for improving strength of magnetic particles carrier is proposed. But in this case, it is also hardly possible to make the content of the magnetic particles not lower than 80% by weight. In this Japanese KOKAI, as a process for producing binder-type carrier by using a thermosetting resin, a process in which a thermosetting resin and magnetic fine particles are mixed, the resultant mixture is melted and then heat-cured by adding a curing agent, and the resulting cured product is pulverized and classified is disclosed. According to this method, however, it is impossible to obtain spherical particles by a hot-air treatment since the resin is thermoset, and the classified-out unnecessary particles can no. be recycled unlike in the case of using a thermoplastic resin, so that industrial application of this method is difficult in terms of cost. As another process for producing binder-type carrier by using a thermosetting resin, the said Japanese KOKAI also discloses a method in which a thermosetting resin is dissolved in a solvent such as toluene, then magnetic fine particles are dispersed therein, and the resultant dispersion is sprayed for granulation and then dried to evaporate way the solvent. The resulting granulated particles are further heat-cured and classified to form the desired carrier particles. According to this method, it is easy to form spherical particles, but since the process involves evaporation of a large amount of solvent, voids are apt to form in the granulated particles, thereby impairing their strength. Also, an apparatus for recovering a large amount of solvent is necessitated, and the classified-out particles with undesired sizes can not be recycled as in the case of the said pulverization method. This method, therefore, is unsuited for practical application. As described above, a variety of carrier particles and processes for producing the carrier particles have been proposed, and some of them have been put to practical use. However, for use in digital copying machines having the latest digital techniques applied to electrophotography, laser beam printers, plain paper facsimiles and other high-technique office machines, there are required the carrier particles having higher performance, that is, the particles which can enable even higher speed operations, higher image quality, higher fineness, and formation of clear color images. Such particles are required to be low in bulk density, to have a curved surface configuration and to be high in content of the ferromagnetic fine particles.

As a result of extensive studies on the process for obtaining the carrier particles having a curved surface configuration, low in bulk density, high saturation magnetization and high electric resistance, it has been found that composite carrier particles comprising more than 80% by weight to not more than 99% by weight of ferromagnetic fine particles and a phenol resin, obtained by reacting phenols and aldehydes in the presence of the ferromagnetic fine particles and a suspension stabilizer in an aqueous medium by using a basic catalyst, have a number-average particle diameter of 10 to 1,000 μm, a bulk density of not more than 2.0 g/cm$^3$ and a curved surface configuration, and are possessed of high saturation magnetization and high electric resistance. The present invention has been achieved on the basis of this finding.

SUMMARY OF THE INVENTION

In a first aspect of the present invention, there is provided composite carrier particles comprising more than 80% by weight to not more than 99% by weight of ferromagnetic fine particles and a phenol resin, and having a number-average particle diameter of 10 to 1,000 μm, a bulk density of not more than 2.0 g/cm$^3$ and a curved surface configuration.

In a second aspect of the present invention, there is provided composite carrier particles comprising more than 80% by weight to not more than 99% by weight of ferromagnetic fine particles and a phenol resin, and having its surface coated with a melamine resin, and having a number-average diameter of 10 to 1,000 μm, a bulk density of not more than 2.0 cm$^3$ and a curved surface configuration.

In a third aspect of the present invention, there is provided a process for producing the composite carrier particles provided in accordance with the said first aspect, which comprises reacting phenols and aldehydes in the presence of ferromagnetic fine particles and a suspension stabilizer in an aqueous medium by using a basic catalyst.

In a fourth aspect of the present invention, there is provided a process for producing the composite carrier particles coated with a melamine resin and provided in accordance with the said second aspect, which comprises reacting phenols and aldehydes in the presence of ferromagnetic fine particles and a suspension stabilizer in an aqueous medium, by using a basic catalyst to form composite particles, and reacting melamines and aldehydes in the presence of the thus obtained composite particles in an aqueous medium to coat the surface of the composite particles with a melamin resin.

DETAILED DESCRIPTION OF THE INVENTION

Figure 1:
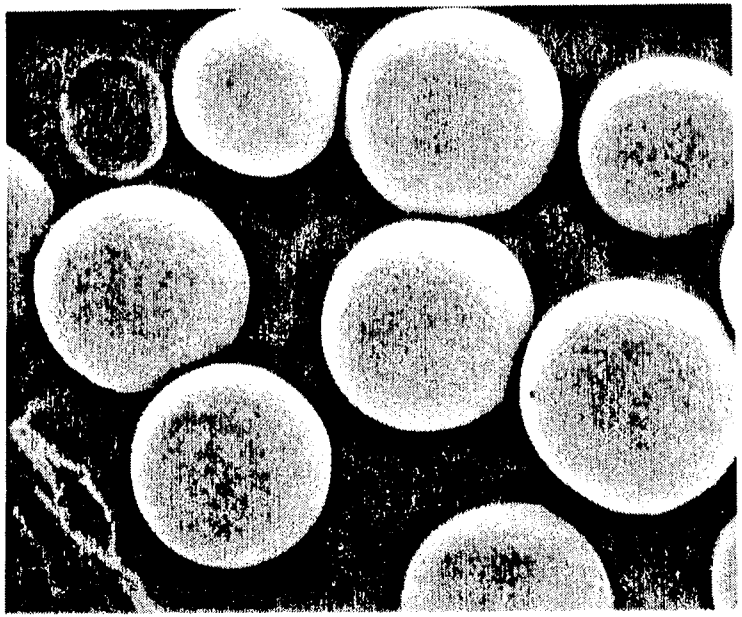
FIG. 1 and 2 are scanning electron microphotographs (×300) showing the structure of the composite particles obtained in Examples 1 and 3, respectively.

The composite carrier particles comprising ferromagnetic fine particles and a phenol resin according to the present invention have a number-average particle diameter of 10 to 1,000 μm. When the number-average particle diameter is less than 10 μm, it becomes difficult to prevent adhesion of carrier to a photoconductive layer, whilst when the number-average particle diameter exceeds, 1,000 μm, it becomes difficult to obtain a clear image. The preferred range of the number-average particle diameter is from 30 to 200 μm, more preferably from 30 to 100 μm, for obtaining high image quality.

The composite carrier particles according to the present invention also have a bulk density of not more than 2.0 g/cm$^3$. In the present invention, there is no specific limitation to the lower limit of the bulk density of the particles, but practically the lower limit of the bulk density is around 1.0 g/cm$^3$. The composite particles with such a low bulk density are deemed to be able to serve as a carrier capable of providing high image quality.

The curved surface configuration is also characteristic of the composite carrier particles according to the present invention. The composite particles with the "curved surface configuration" include spherical particles, oval particles, flat disc-like particles, and warped particles with complex curvatures. Any one of these composite particles is small in contact area between the particles because of the curved surface configuration, and exhibit excellent fluidity. Especially the spherical composite particles are preferred since the spherical particles are excellent in fluidity, minimized in distortion of the particle shape and also high in particle strength.

In the composite carrier particles according to the present invention, the content of the ferromagnetic fine particles is more than 80% by weight to not more than 99% by weight, preferably 80–97% by weight. When the content of the ferromagnetic fine particles is not more than 80% by weight, the saturation magnetization lowers, and when the said content exceeds 99% by weight, the adhesion between the ferromagnetic fine particles by the phenol resin tends to weaken. In view of strength of the composite particles, the content of the ferromagnetic fine particles is preferably not higher than 97% by weight. The reason why the content of the ferromagnetic fine particles can be made so high in the present invention is not clarified, but it is supposed that the ferromagnetic fine particles are bonded fast to each other with a small amount of the phenol resin because the gelation proceeds simultaneously with the primary reaction.

The composite carrier particles according to the present invention have a saturation magnetization of about 40 to 150 emu/g. When this saturation magnetization is less than 40 emu/g, there tends to take place adhesion of the carrier particles to the photoconductive layer. It is difficult to obtain the composite particles having a saturation magnetization of more than 150 emu/g because there is known no ferromagnetic particles which can be practically used for the said purpose in the form of fine particles. The saturation magnetization of the ferrite carrier, which is known in the art, is about 70 emu/g at highest (refer to Basis and Application of Electrophotographic Techniques, p. 481, 1988, Corona Pub. Co.), but in the case of the composite carrier particles according to the present invention, it is possible to obtain easily a saturation magnetization of higher than 70 emu/g with ease by increasing the content of fine ferrite.

As the ferromagnetic fine particles, there can be used fine iron oxide particles of magnetite and maghemaite, spinel ferrite containing one or more of metals other than iron (such as Mn, Ni, Zn, Mg, Cu, etc.), magnetoplumbite type ferrite such as barium ferrite, and iron or alloys having an oxide layer on the surface. The shape of the ferromagnetic fine particles may be granular, spherical or acicular. Ferromagnetic fine particles such as iron particles may be used in applications where especially high magnetization is required, but considering chemical stability, it is preferred to use fine iron oxide particles of magnetite and maghemaite, spinel ferrite or magneto-plumbite type ferrite such as barium ferrite. It is possible to obtain composite particles having a desired saturation magnetization by properly selecting the kind and content of the ferromagnetic fine particles. For example, when it is desired to obtain a magnetization of 40 to 70 emu/g, it is suggested to use magnetoplumbite type ferrite such as barium ferrite or spinel ferrite, and when it is desired to obtain a high magnetization of 70 to 100 emu/g, it is advised to use magnetite or spinel ferrite containing Zn. In case of obtaining a magnetization of higher than 100 emu/g, one may use fine particles of iron or an alloy having an oxide layer on the surface.

The composite carrier particles according to the present invention are also satisfactory in strength as the ferromagnetic fine particles are bonded to each other with a cured phenol resin as matrix.

The coating weight of melamine resin on the surface of the composite particle is preferably not less than 0.05% by weight based on the core composite particles. When the said coating weight is less than 0.05% by weight, the formed coating film may become unsatisfactory in strength and non-uniform, and as a result, it is difficult to obtain the effect of increasing the electric resistance purposed in the present invention. The preferred range of the said coating weight is 0.1 to 10% by weight based on the core composite particles.

A process for producing the composite carrier particle of the present invention essentially comprises reacting phenols and aldehydes in an aqueous medium in the presence of a basic catalyst by allowing ferromagnetic fine particles and a suspension stabilizer to coexist in the aqueous medium.

As the phenols used in the process of the present invention, phenol; alkylphenols such as m-cresol, p-tert-butylphenol, o-propylphenol, resorcinol, bisphenol A, etc.; and the compounds having phenolic hydroxide groups such as halogenated phenols in which benzene nuclea or alkyl groups are partly or wholly substituted with chlorine or bromine atoms, may be exemplified. Among them, phenol is the most preferred.

As the aldehydes used in the process of the present invention, formaldehyde in the form of formalin or paraformaldehyde and furfural may be exemplified. Formaldehyde is especially preferred. The molar ratio of aldehydes to phenols is 1 to 2, preferably 1.1 to 1.6. When the said molar ratio is less than 1, it is hard to produce the composite particles, and even if the composite particles could be produced, the formed composite particles tend to become weak in strength because the curing of the produced resin is hard to proceed. On the other hand, when the said molar ratio is higher than 2, the remaining amount of aldehydes unreacted in the aqueous medium after the reaction tends to increase.

As basic catalysts used in the process of the present invention, there can be used those which are usually used in the production of resol resins. Examples of such basic catalysts are ammonia water, hexamethylenetetramine and alkylamines such as dimethylamine, diethyltriamine, polyethyleneimine, etc. The molar ratio of the basic catalysts to phenols is preferably in the range of 0.02 to 0.3.

The amount of the ferromagnetic fine particles used in the process of the present invention is preferably 0.5 to 200 times (by weight) the amount of phenols. In view of the saturation magnetization of the produced composite particles and the particle strength, it is more preferable that the amount of the ferromagnetic fine particles is 4 to 100 times (by weight) the amount of phenols.

Also, the ferromagnetic fine particles preferably have a diameter in the range of 0.01 to 10 μm. The more preferred particle diameter is 0.05 to 5 μm in view of dispersion of the fine particles in the aqueous medium and strength of the produced composite particles.

As suspension stabilizer used in the process of the present invention, there can be used hydrophilic organic compounds such as carboxymethyl cellulose and polyvinyl alcohol; fluorine compounds such as calcium fluoride; and substantially water-insoluble inorganic salts such as calcium sulfate. Calcium fluoride is preferred from the viewpoint of dispersion of the ferromagnetic fine particles into the inside of phenol resin matrix.

The amount of such suspension stabilizer used in the process of the present invention is preferably 0.2 to 10% by weight, more preferably 0.5 to 3.5% by weight based on phenols. When the amount of the suspension stabilizer added is less than 0.2% by weight based on phenols, irregular particles tend to be produced. On the other hand, when the amount of the suspension stabilizer exceeds 10% by weight based on phenols, the remaining amount of the suspension stabilizer such as calcium fluoride on the surface of the produced composite particles tends to increase.

In the case of adding a substantially water-insoluble inorganic salt, it is possible either to directly add the substantially water-insoluble inorganic salt or to add two or more different kinds of water-soluble inorganic salts so that a substantially water-insoluble inorganic salt would be produced in the course of reaction. For instance, instead of using calcium fluoride, it is possible to add at least one compound selected from the group consisting of sodium fluoride, potassium fluoride, ammonium fluoride and the like as one of water-soluble inorganic salts, while further adding at least one compound selected from the group consisting of chloride, sulfate and nitrate of calcium as another water-soluble inorganic salt so that calcium fluoride would be produced in the course of reaction.

The reaction in the process of the present invention is carried out in an aqueous medium. In this reaction, the amount of water supplied is so selected that the solids concentration would become preferably 30 to 95% by weight, more preferably 60 to 90% by weight.

For carrying out the reaction, the mixture is gradually heated at a rate of 0.5 to 1.5° C/min, preferably 0.8 to 1.2° C/min under stirring, and the reaction is performed at a temperature of 70 to 90° C., preferably 83 to 87° C., for a period of 60 to 150 minutes, preferably 80 to 110 minutes.

In the process of the present invention, this reaction is accompanied by a gelation reaction to form a gelled phenol resin matrix. After the said reaction and gelation have been completed, the reaction product is cooled to a temperature below 40° C., thereby forming a water dispersion of spherical particles comprising the ferromagnetic fine particles dispersed uniformly in the gelled phenol resin matrix.

This water dispersion is separated into solid and water by a conventional method such as filtration, centrifugation, etc., and the solid matter is washed and dried, whereby obtaining the composite particles having a curved surface configuration in which the ferromagnetic fine particles are dispersed uniformly in the phenol resin matrix.

The coating with the melamine resin in the present invention is performed by reacting melamines and aldehydes inn the presence of the composite particles under stirring in a neutral of weakly basic aqueous medium, and gelling the reaction mixture. The melamines and aldehydes are made into ultra-fine particles insoluble in water as the reaction proceeds, and a state of suspension is generated. It is, therefore, expedient to allow a suspension stabilizer to coexist in the reaction system. AS the suspension stabilizer, there can be used hydrophilic organic compounds and water-insoluble inorganic compounds as in the case of formation of phenol resin described above. The gelation may be conducted in the presence of an acidic catalyst, if necessary. The gelled product is cured by heat-treatment at a temperature of preferably 130 to 150° C.

The ultra-fine particles of melamine resin are coated uniformly and densely on the surface of the composite particles, thereby enabling effective improvement of the electric resistance of the composite particles. Further, the coating of the ultra-fine particles of melamine resin enlarges the specific surface area of composite particles, thereby obtaining a high electric resistance.

As the melamines, there can be used melamine and its formaldehyde addition products such as dimethylolmelamine, trimethylolmelamine, hexamethylolmelamine and the like. A melamine-formaldehyde precondensate is also usable. Among them, melamine is the most preferred.

In the process of the present invention, the melamines are used preferably in an amount of 0.5 to 10% by weight, more preferably 2 to 7% by weight based on the core composite particles. When the amount of the melamines used is less than 0.5% by weight based on the core composite particles, the desired coating can not be obtained, and when it exceeds 10% by weight based on the core composite particles, the ultra-fine particles of melamine resin are formed independently and the separation thereof from the thus obtained composite particles becomes difficult.

As the aldehyde, formaldehyde or acetaldehyde is preferred, but it is also possible to use formaldehyde in the form of formalin or paraformaldehyde, and the compounds such as furfural, which are decomposed to produce formaldehyde.

The amount of the aldehydes used in the process of the present invention is 1 to 10, preferably 2 to 6 in a molar ratio to melamines. When the molar ratio of aldehydes to melamines is less than 1.0, it is hard to produce melamine resin, and when it exceeds 10, the remaining amount of the aldehydes unreacted in the aqueous medium after the reaction increases.

As the acidic catalyst used, if necessary, in the process of the present invention, formic acid, phosphoric acid, oxalic acid, ammonium chloride, p-toluenesulfonic acid and the like may be exemplified. An amount (molar ratio) of such the acidic catalyst used to the melamines is preferably not more than 10.

As the suspension stabilizer used, if necessary, in the process of the present invention, there can be used the same stabilizer as the one used in the composite particle forming reaction. Such the suspension stabilizer is used in an amount of preferably not more than 15% by weight, more preferably not more than 10% by weight based on the melamines. When the amount of the suspension stabilizer is more than 15% by weight based on the melamines, the remaining amount of suspension stabilizer such as calcium fluoride on the particle surfaces tends to increase.

The reaction in the process of the present invention is carried out in an aqueous medium. The amount of water supplied in this reaction is not particularly specified, but the amount of water supplied is so selected that the particle concentration would become preferably 30 to 60% by weight.

An example of the coating reaction with melamine resin in the process of the present invention is described below.

Aqueous solutions of two or more compounds capable of forming the substantially water-insoluble inorganic salts, the melamines, the aldehydes and the above-described described composite particles are added at normal temperature in an aqueous medium under vigorous stirring to prepare a mixed solution. After adjusting the pH of the mixed solution to 7 to 9.5, the resultant solution is heated at a rate of 0.5 to 1.5° C./min, preferably 0.8 to 1.2° C./min under stirring, till reaching 70 to 90° C., preferably 80 to 85° C., and reacted at this temperature for 10 to 30 minutes, preferably 15 to 20 minutes. The reaction mixture is cooled to a temperature below 30° C., and after adding an acidic catalyst, the reaction mixture is then heated gradually at a rate of 0.5 too 1.5° C./min., preferably 0.8 to 1.2° C. under stirring, and further reacted at a temperature of 75 to 95° C, preferably 80 to 90° C. for 60 to 150 minutes, preferably 80 to 110 minutes. As this reaction advances, there takes place concurrently a gelation reaction by which the surface of the composite particle is coated with melamine resin.

After completion of the said reaction and coating, the reaction product is cooled to a temperature below 30° C., whereupon there is obtained a water dispersion of the composite particles having their surfaces coated with the ultra-fine particles of melamine resin.

This dispersion is then separated into solid and liquid according to a conventional method such as filtration, centrifugation, etc., and the obtained solid product is dried and heat treated at a temperature of, for example, 130 to 150° C. to cure the ultra-fine particulate melamine resin. Consequently, there are obtained the composite particles having their surfaces coated uniformly with cured melamine resin in the form of the ultra-fine particles.

The composite particles to be coated with the melamine resin in the present invention may be any of the ones which have been dried in vacuo, the ones which have been dried under normal pressure, and the ones which have been just filtered and are still in a wet state.

The composite carrier particles comprising the ferromagnetic fine particles and the phenol resin according to the present invention are low in bulk density, for example, not more than 2.0 g/cm$^3$, preferably not more than 1.95 g/cm$^3$, have a curved surface configuration and a high electric resistance, for example, a volumetric electric resistance of not less than $1\times10^5$ Ω.cm, preferabbly not less than $1\times10^6$ Ω.cm, and also shows a high saturation magnetization, for example, not less than 40 emu/g owing to the high content of the ferromagnetic fine particles, so that these composite particles are suited for use as magnetic carrier for electrophotography.

It is further possible with the above-described process of the present invention to easily produce the composite particles composed of the ferromagnetic fine particles and the phenol resin.

Also, the composite carrier particles comprising the ferromagnetic fine particles and the phenol resin and having their surfaces coated with the melamine resin according to the present invention are also low in bulk density, for example, not more than 2.0 g/cm$^3$, preferably not more than 1.85 g/cm$^3$, more preferably not more than 1.70 g/cm$^3$, show high saturation magnetization, for example, not less than 40 emu/g owing to the high content of ferromagnetic fine particles and have a high electric resistance, for example, a volumetric electric resistance of not less than $1\times10^{10}$ Ω.cm, preferably not less than $1\times10^{11}$ Ω.cm due too coating with the melamine resin, so that these composite particles can be also used advantageously as magnetic carrier for electrophotography.

It is remarkable that the composite carrier particles having their surfaces coated with the melamine resin according to the present invention have an additional advantage of enhanced durability as the melamine resin used for coating is a thermosetting resin with high strength.

It is to be further noted that the process according to the present invention is capable of easily producing the composite carrier particles composed of the ferromagnetic fine particles and the phenol resin, and further it is possible to sufficiently increase electric resistance by coating treatment with the melamine resin, so that the process of the present invention is advantageous industrially and economically.

EXAMPLES

The present invention will be hereinbelow described more particularly by showing the examples and comparative examples, but it is to be understood that these examples are merely intended to be illustrative and not to be construed as limiting the scope of the invention.

Each number-average particle diameter shown in the present invention is the mean value of the diameters of 200 particles measured from a light micrograph.

Bulk density was measured according to the method shown in JIS K.5101.

Saturation magnetization was measured by using a vibrating sample type magnetometer VSM.3S.15 (manufactured by Toei Industries Co., Ltd.).

Electric resistance was measured by High Resistance Meter 4329A (mfd. by Yokogawa Hewlett-Packard, Ltd.).

The shapes of composite particles were determined from observation through a scanning electron microscope S-800 (manufactured by Hitachi Co., Ltd.).

Production of composite carrier particles

EXAMPLE 1

50 g of phenol, 65 g of 37% formalin, 400 g of spherical magnetite particles having an average particle diameter of 0.24 μm, 7.8 g of 28% ammonia water, 1 g of calcium fluoride and 50 g of water were supplied into and stirred in a 1.liter three-necked flask. The mixture was heated to 85° C., over a period of 40 minutes and reacted at this temperature for 180 minutes to produce the composite particles composed of magnetite particles and gelled phenol resin.

Then the resultant contents in the flask was cooled to 30° C. and added with 0.5 liter of water. After removing the supernatant, the spherical particles in the lower layer were washed with water and air dried. They were then further dried at 50 to 60° C. under reduced pressure (below 5 mmHg) to obtain spherical composite particles (hereinafter referred to as composite particles A).

A scanning electron micrograph (×300 magnification) of the thus obtained composite particles A is shown in FIG. 1.

EXAMPLE 2

By carrying out the same reaction, after-treatments as in Example 1 except for 4.5 g of hexamethylenetetramine instead of 7.8 g of 28% ammonia water as basic catalyst, there were obtained spherical composite particles (hereinafter referred to as composite particles B).

EXAMPLES 3-8 AND COMPARATIVE EXAMPLES 1 AND 2

By carrying out the same reaction, after-treatments as in Example 1 except that the kinds and amount of ferromagnetic fine particles and the amount of suspension stabilizer were changed as shown in Table 1, there were obtained the corresponding composite particles (hereinafter the composite particles obtained in Examples 3, 4, 5, 6, 7 and 8 and Comparative Examples 1 and 2 are referred to as composite particles C, D, E, F, G, H, I and J, respectively).

Figure 2:
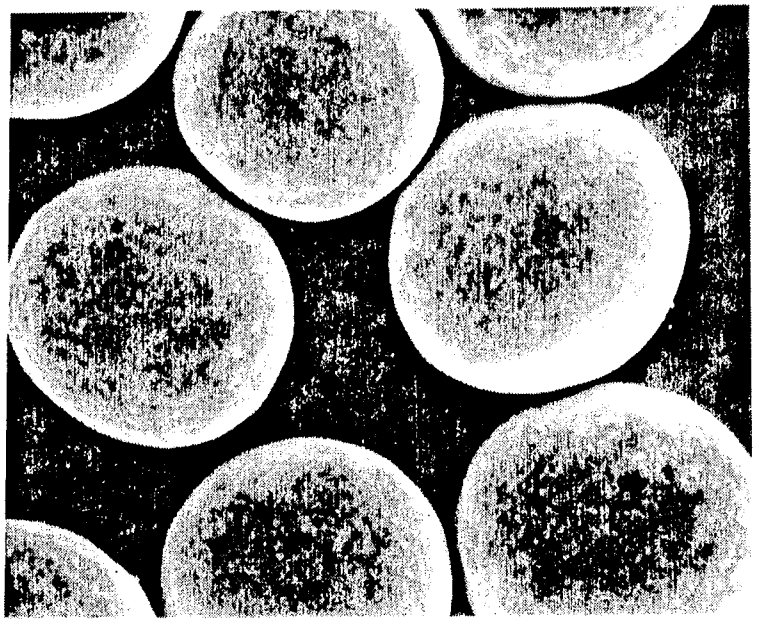

A scanning electron micrograph (×300 magnification) of the composite particles C obtained in Example 3 is shown in FIG. 2.

REFERENTIAL EXAMPLE 1

Magnetic developers were prepared by mixing 100 parts by weight of each of the composite particles A-J (as carrier) obtained in Examples 1-8 and Comparative Examples 1 and 2, and 3 parts by weight of a commercially available toner. Each of the prepared developers was subjected to copying-test in which, by using each the said developer, 20,000 copies were taken with A4 size paper by an electrophotographic copying machine using α-Si as photoconductive material. Thereafter, the state of the surface of the photoconductive layer and the state of the developer in the copying machine were examined. In the case of the developers containing composite particles A-H of the present invention as carrier, there was observed no adhesion of composite particles on the surface of the photoconductive layer nor any break of composite particles. On the other hand, in the case of the developer containing comparative composite particles I, the particles were broken into finer sizes, and in the case of the developer containing comparative composite particles J, there was seen adhesion of the particles on the surface of the photoconductive layer.

TABLE 1

| Examples and Comparative Examples | | Ferro-magnetic fine particles | | | Suspension stabilizer | | Basic catalyst | | Phenols | | Aldehydes | Composite particles |
|---|---|---|---|---|---|---|---|---|---|---|---|---|
| | | Kind | Average diameter (μm) | Amount (g) | Kind | Amount (g) | Kind | Amount (g) | Kind | Amount (g) | Amount of 37% formalin | |
| Examples | 1 | Spherical magnetite | 0.24 | 400 | Calcium fluoride | 1.0 | 28% ammonia water | 7.8 | Phenol | 50 | 65 | A |
| | 2 | Spherical magnetite | 0.24 | 400 | Calcium fluoride | 1.0 | Hexamethylenetetramine | 4.5 | " | 50 | 65 | B |
| | 3 | Polyhedral magnetite | 0.26 | 450 | Calcium fluoride | 1.0 | 28% ammonia water | 7.8 | " | 50 | 65 | C |
| | 4 | Granular iron-powder | 0.23 | 400 | Calcium fluoride | 1.0 | 28% ammonia water | 7.8 | " | 50 | 65 | D |
| | 5 | Plate-like barium ferrite | 0.24 | 400 | Calcium fluoride | 1.0 | 28% ammonia water | 7.8 | " | 50 | 65 | E |
| | 6 | Spherical magnetite | 0.24 | 200 | Calcium fluoride | 0.3 | 28% ammonia water | 7.8 | " | 50 | 65 | F |
| | 7 | Zinc-added spherical magnetite | 0.25 | 450 | Calcium fluoride | 1.0 | 28% ammonia water | 7.8 | " | 50 | 65 | G |
| | 8 | Polyhedral magnetite | 0.26 | 400 | Calcium fluoride | 0.25 | 28% ammonia water | 7.8 | " | 50 | 65 | H |
| Comp. Examples | 1 | Spherical magnetite | 0.24 | 1500 | Calcium fluoride | 1.0 | 28% ammonia water | 7.8 | " | 50 | 65 | I |
| | 2 | Spherical magnetite | 0.24 | 20 | Calcium fluroide | 1.0 | 28% ammonia water | 7.8 | " | 50 | 65 | J |

TABLE 2

| Examples and Comparative Examples | | Composite particle | Number average particle diameter (μm) | Bulk density (g/cm$^3$) | Shape | Content of ferro-magnetic fine particles (wt %) | Saturation magnetization (emu/g) | Volumetric electric resistance (Ω · cm) |
|---|---|---|---|---|---|---|---|---|
| Examples | 1 | A | 81.2 | 1.82 | Spherical | 93 | 78 | $1.2 \times 10^6$ |
| | 2 | B | 103.5 | 1.89 | " | 88 | 75 | $2.6 \times 10^6$ |

TABLE 2-continued

| Examples and Comparative Examples | Composite particle | Number average particle diameter (μm) | Bulk density (g/cm³) | Shape | Content of ferro-magnetic fine particles (wt %) | Saturation magnetization (emu/g) | Volumetric electric resistance (Ω · cm) |
|---|---|---|---|---|---|---|---|
| 3 | C | 127.1 | 1.62 | " | 97 | 82 | $7.3 \times 10^5$ |
| 4 | D | 88.5 | 1.93 | " | 90 | 135 | $1.0 \times 10^6$ |
| 5 | E | 78.8 | 1.75 | " | 85 | 47 | $8.5 \times 10^6$ |
| 6 | F | 175.7 | 1.56 | Disc-like | 82 | 70 | $3.5 \times 10^6$ |
| 7 | G | 86.5 | 1.85 | Spherical | 97 | 92 | $7.2 \times 10^6$ |
| 8 | H | 78.8 | 1.78 | Amorphous with curved surface configuration | 91 | 77 | $5.2 \times 10^6$ |
| Comp. Examples 1 | I | 82.5 | 2.04 | Spherical | 99.6 | 84 | $2.7 \times 10^5$ |
| Comp. Examples 2 | J | 80.3 | 1.48 | " | 32.5 | 28 | $5.7 \times 10^{11}$ |

Production of composite carrier particles coated with melamine resin

EXAMPLE 9

5.4 g of melamine, 10.5 g of 37% formalin, 160 g of composite particles A obtained in Example 1, 0.35 g of calcium fluoride and 200 g of water were supplied into a 500 ml three-necked flask. Under stirring, the solution was adjusted to a pH of 8.5 with sodium hydroxide, and the resultant mixture is heated to 85° C over a period of 40 minutes and reacted at this temperature for 15 minutes.

Then the contents in the flask was cooled to 30° C., and after adding 30 g of 5% ammonium chloride, the resultant contents heated to 85° C over a period of 60 minutes and reacted at this temperature for 90 minutes.

The reacted product in the flask was again cooled to 30° C., transferred into a 1 liter beaker, washed with water several times and then air dried. The product was further dried at 100–150° C. under reduced pressure (below 5 mmHg).

The amount of melamine resin of the resultantly obtained melamine resin-coated composite particles; when calculated from measurement of magnetization, was 1.9% by weight based on the composite particles.

Figure 3:
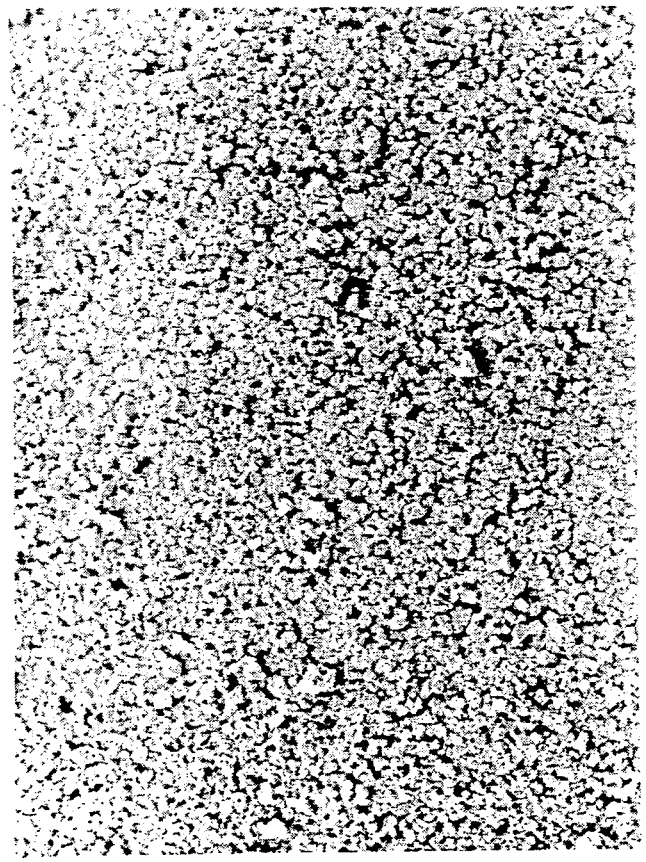
FIG. 3 is a scanning electrophotograph (×3000) showing the structure of the surface of a composite particle before coating with a melamine resin obtained in Example 1.

The structure of the surface of the composite particle before coating with a melamine resin, that is, the composite particle obtained in Example 1 is shown in FIG. 3 (scanning electron micrograph of 3,000 magnification).

Figure 4:
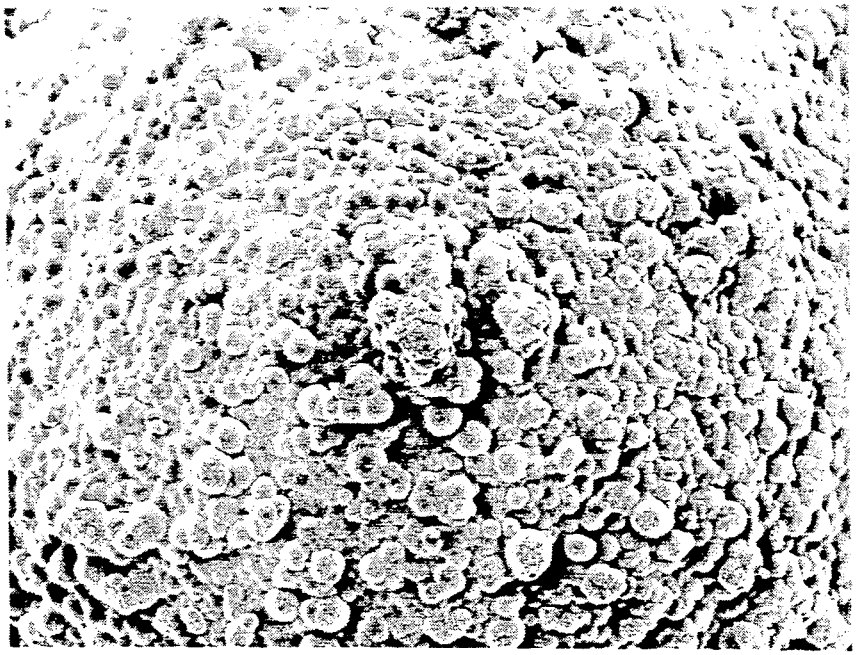
FIG. 4 is a scanning electron microphotograph (×3,000) showing the structure of the surface of a composite particle coated with a melamine resin obtained in Example 9.

The melamine resin coat of the composite particles obtained in Example 9, as seen from a scanning electron micrograph (×3,000 magnification) shown in FIG. 4, was sufficient and uniform, and it was also noted that the coating melamine resin was in the form of ultra-fine particles.

EXAMPLE 10

Melamine resin coating was performed in the same manner as Example 9 except for PVA instead of calcium fluoride as suspension stabilizer. The main producing conditions in this process are shown in Table 3.

The amount of melamine resin of the obtained melamine resin-coated composite particles, as calculated from measurement of magnetization, was 2.0% by weight based on composite particles.

The melamine resin coat of the composite particles obtained in Example 10, as observed by a scanning electron microscope, was sufficient and uniform, and the coat was composed of melamine resin in the form of ultra-fine particles.

EXAMPLE 11

100 g of composite particles C obtained in Example 3, 3 g of melamine monomer, 8 g of 37% formalin and 100 ml of water were supplied into and mechanically stirred in a four-necked flask equipped with a condenser. The mixture was heated to 75° C and stirred for 2 hours while maintaining this temperature. Then the contents was cooled to room temperature, filtered, washed with water and then dried and cured at 150° C under reduced pressure (below 5 mmHg) for 6 hours.

The amount of melamine resin of the thus obtained melamine resin-coated composite particles, when calculated from the measurement of saturation magnetization, was 2.1% by weight based on composite particles.

Observation by a scanning electron microscope showed that the melamine resin coat of the composite particles obtained in Example 11 was sufficient and uniform, and also the coat was composed of ultrafine particulate melamine resin.

EXAMPLES 12–15

Melamine resin coating of composite particles was performed in the same manner as Example 11 except for changes of the kind and amount of composite particles, amount of melamine monomer, amount of aldehydes and amount of water.

The main producing conditions in this process and various properties of the obtained melamine resin-coated composite particles are shown in Table 3.

REFERENTIAL EXAMPLE 2

By using the melamine resin-coated composite particles obtained in Examples 9–15 as magnetic carrier, there were prepared the magnetic developers by mixing 100 parts by weight of the respective composite particles with 3 parts by weight of a commercial toner. Then, by using each of the, thus prepared developers, there was conducted a copying test in which 20,000 copies with A4 size paper were taken by an electrophotographic copying machine using a-Si as photoconductive material. In the copying tests using the developers containing the magnetic carriers obtained in Examples 9–15, there were obtained clear copied images.

TABLE 3

| Examples | Composite particles Kind | Composite particles Weight (g) | Coating with melamine resin: Amount of melamines g (mol/l) | Aldehydes Kind | Aldehydes Amount added (g) | Suspension stabilizer Kind | Suspension stabilizer Amount added (g) | Acidic catalyst Kind | Acidic catalyst Amount added (g) | Water (g) |
|---|---|---|---|---|---|---|---|---|---|---|
| Example 9 | A | 160 | 5.4 (0.21) | 37% formalin | 10.5 | Calcium fluoride | 0.35 | 5% ammonium chloride | 30 | 200 |
| Example 10 | A | 160 | 5.4 (0.21) | 37% formalin | 10.5 | PVA | 0.35 | 5% ammonium chloride | 30 | 200 |
| Example 11 | C | 100 | 3 (0.24) | 37% formalin | 8 | — | — | — | — | 100 |
| Example 12 | A | 50 | 2 (0.16) | 37% formalin | 5 | — | — | — | — | 100 |
| Example 13 | A | 50 | 4 (0.16) | 37% formalin | 10 | — | — | — | — | 200 |
| Example 14 | B | 100 | 5 (0.2) | 37% formalin | 12 | — | — | — | — | 200 |
| Example 15 | C | 100 | 15 (0.17) | 37% formalin | 35 | — | — | — | — | 700 |

| Examples | Number-average particle diameter (μm) | Shape | Content of ferro-magnetic fine particles (wt %) | Composite particles coated with melamine resin: Coating weight of melamine resin (wt %) | Bulk density (g/cm³) | Saturation magnetization (emu/g) | Volumetric electric resistance (Ω · cm) |
|---|---|---|---|---|---|---|---|
| Example 9 | 83.2 | Spherical | 91 | 1.9 | 1.58 | 75.3 | $2.0 \times 10^{13}$ |
| Example 10 | 84.5 | " | 91 | 2.0 | 1.57 | 75.8 | $2.6 \times 10^{13}$ |
| Example 11 | 137.2 | " | 95 | 2.1 | 1.55 | 80.3 | $5.2 \times 10^{13}$ |
| Example 12 | 82.8 | " | 91 | 1.6 | 1.62 | 76.7 | $5.8 \times 10^{11}$ |
| Example 13 | 85.0 | " | 90 | 2.6 | 1.43 | 76.0 | $6.1 \times 10^{13}$ |
| Example 14 | 110.2 | " | 86 | 1.9 | 1.58 | 73.6 | $3.2 \times 10^{12}$ |
| Example 15 | 139.1 | " | 92 | 5.2 | 1.2 | 77.7 | $7.2 \times 10^{13}$ |

What is claimed is:

1. Spherical or oval composite carrier particles for electrophotography comprising 80 to 99% by weight of ferromagnetic fine particles and a phenol resin, and having a number-average particle diameter of 10 to 1,000 μm and a bulk density of not more than 2.0 g/cm³.

2. The spherical or oval composite carrier particles according to claim 1, which have a melamine resin coating on the surface thereof.

3. The spherical or oval composite carrier particles according to claim 2, wherein the coating weight of melamine resin is not less than 0.05% by weight based on the core composite particle.

4. The spherical or oval composite carrier particles according to claim 2, which have a volumetric electric resistance of not less than $1 \times 10^{10}$ Ω. cm.

5. The spherical or oval composite carrier particles according to claim 1 or 2, which have a saturation magnetization of 40 to 150 emu/g.

6. The spherical or oval composite carrier particles according to claim 1, wherein said ferromagnetic fine particles have a diameter of 0.01 to 10 μm.

7. The spherical or oval composite carrier particles according to claim 1, which have a volumetric electric resistance of not less than $1 \times 10^{5}$ Ω. cm.

8. A process for producing spherical or oval composite carrier particles comprising 80 to 99% by weight of ferromagnetic fine particles and a phenol resin, and having a number-average particle diameter of 10 to 1,000 μm and a bulk density of not more than 2.0 g/cm³, which process comprises reacting a phenol and an aldehyde inn the presence of ferromagnetic fine particles and a suspension stabilizer in an aqueous medium using a basic catalyst.

9. The process according to claim 8 wherein the molar ratio of said aldehyde to said phenol is 1 to 2, the molar ratio of said basic catalyst to said phenol is 0.02 to 0.3, the amount of said ferromagnetic fine particles ib 0.5 to 200 times (by weight) the amount of said phenol, and the amount of said suspension stabilizer is 0.2 to 10% by weight based on said phenol.

10. The process according to claim 8, wherein the reaction is carried out at a temperature of 70 to 90° C. for 60 to 150 minutes.

11. A process for producing spherical or oval composite carrier particles and having a melamine resin coating on the surface thereof, which process comprises reacting a melamine and an aldehyde in the presence of the spherical or oval composite particles comprising 80 to 99% by weight of ferromagnetic fine particles and a phenol resin, and having a number-average particle diameter of 10 to 1,000 μm and a bulk density of not more than 2.0 g/cm³ in an aqueous medium, thereby coating the surfaces of the composite particles with a melamine resin.

12. The process according to claim 11, wherein the amount of said melamine is 0.5 to 10% by weight based on the core spherical or oval composite particles and the molar ratio of said aldehyde to said melamine is 1 to 10.

13. The process according to claim 11, wherein the reaction is carried out at a temperature of 70 to 90° C for 10 to 30 minutes.

* * * * *